US005803455A

United States Patent [19]

Falzarano

[11] Patent Number: 5,803,455

[45] Date of Patent: Sep. 8, 1998

[54] MILITARY BOARD GAME

[76] Inventor: Carmine L. Falzarano, 1803 Brighton Ct., Atwater, Calif. 95301

[21] Appl. No.: 963,632

[22] Filed: Nov. 6, 1997

[51] Int. Cl.[6] ..... A63F 3/00

[52] U.S. Cl. ..... 273/255; 273/249; 273/262

[58] Field of Search ..... 273/242, 243, 273/248, 249, 255, 262

[56] References Cited

U.S. PATENT DOCUMENTS

| | | | |
|---|---|---|---|
| 2,799,504 | 7/1957 | Keyko | 273/262 X |
| 4,993,718 | 2/1991 | Dandridge et al. | 273/249 |
| 5,020,805 | 6/1991 | Fratangelo et al. | 273/262 X |
| 5,092,606 | 3/1992 | Miller | 273/249 |
| 5,511,792 | 4/1996 | Simmons et al. | 273/249 X |
| 5,645,279 | 7/1997 | Rentlinger | 273/249 |

*Primary Examiner*—William E. Stoll

[57] ABSTRACT

A board game is provided including a game board with a top surface and a bottom surface. The top surface has a first indicia, a second indicia and a single path connected between the first indicia and second indicia comprising a plurality of squares. A predetermined number of the squares include trap indicia printed therein. Also included are a plurality of first human tokens each representative of a soldier and a plurality of second human tokens each representative of a prisoner. A plurality of playing cards include trap cards each having a number of human tokens lost printed thereon. To facilitate play, a plurality of dice are provided. During such play, the players attempt to move the soldier human tokens from the first indicia to the second indicia whereafter the players attempt to move the prisoner human tokens from the second indicia to the first indicia.

5 Claims, 2 Drawing Sheets

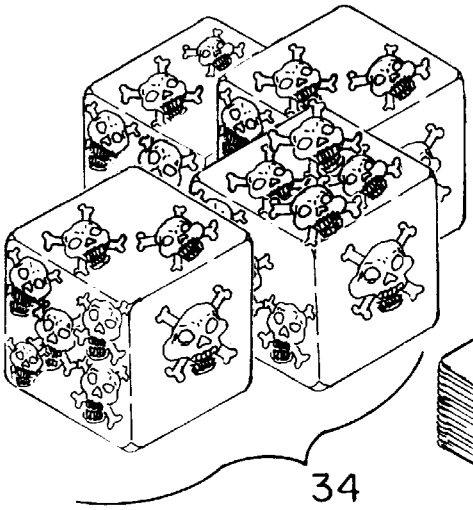
FIG. 2
FIG. 3
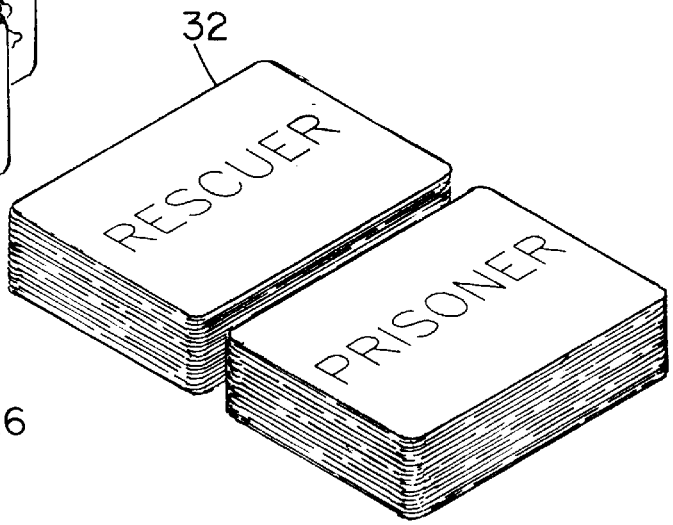
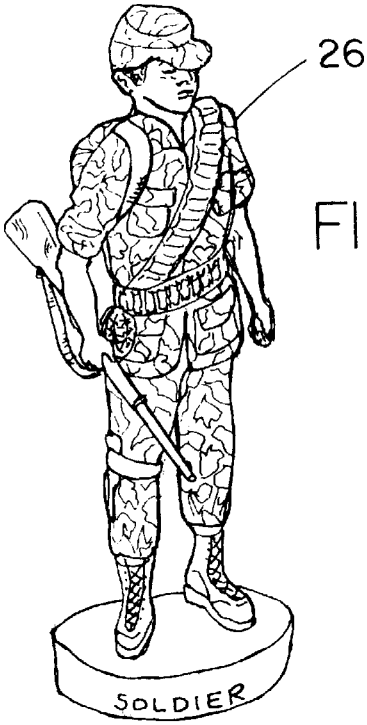
FIG. 4A
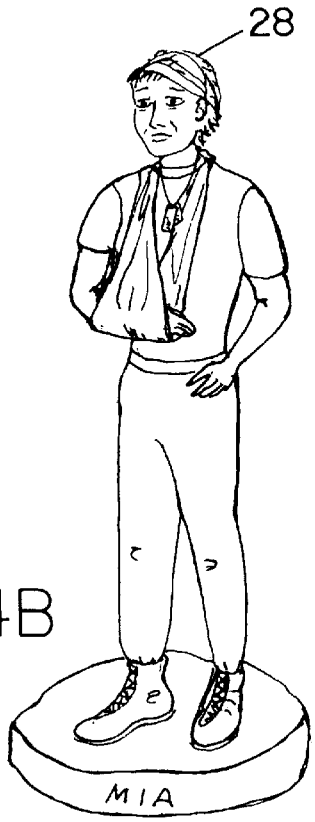
FIG. 4B
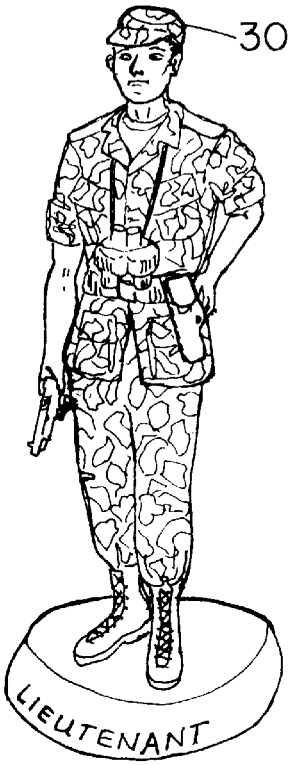
FIG. 4C

MILITARY BOARD GAME

BACKGROUND OF THE INVENTION

1. Field of the Invention

The present invention relates to board games and more particularly pertains to a new military board game for simulating the rescue of prisoners of war with a board game.

2. Description of the Prior Art

The use of board games is known in the prior art. More specifically, board games heretofore devised and utilized are known to consist basically of familiar, expected and obvious structural configurations, notwithstanding the myriad of designs encompassed by the crowded prior art which have been developed for the fulfillment of countless objectives and requirements.

Known prior art board games include U.S. Pat. No. 5,388,837; U.S. Pat. No. 4,982,965; U.S. Pat. Des. No. 356,833; U.S. Pat. No. 4,570,939; U.S. Pat. No. 5,118,412; and U.S. Pat. No. 4,132,412.

In these respects, the military board game according to the present invention substantially departs from the conventional concepts and designs of the prior art, and in so doing provides an apparatus primarily developed for the purpose of simulating the rescue of prisoners of war with a board game.

SUMMARY OF THE INVENTION

In view of the foregoing disadvantages inherent in the known types of board games now present in the prior art, the present invention provides a new military board game construction wherein the same can be utilized for simulating the rescue of prisoners of war with a board game.

The general purpose of the present invention, which will be described subsequently in greater detail, is to provide a new military board game apparatus and method which has many of the advantages of the board games mentioned heretofore and many novel features that result in a new military board game which is not anticipated, rendered obvious, suggested, or even implied by any of the prior art board games, either alone or in any combination thereof.

To attain this, the present invention generally comprises a game board having a rectangular configuration with a top surface and a bottom surface. The top surface includes a first large box indicia situated at a first corner thereof and a second large box indicia. The second large box indicia is situated at a second corner thereof diagonally situated within respect to the first corner thereof. Note FIG. 1. A plurality of elongated vertical rows are situated on the game board. Each vertical row comprises a plurality of adjacent squares situated therealong. Associated therewith is a plurality of short horizontal rows each comprising a plurality of adjacent squares situated therealong. The vertical rows and horizontal rows are connected to define a single path connected between the first large box indicia and second large box indicia. The top surface further has a plurality of elongated rectangular strips connected between squares situated within adjacent vertical paths. A predetermined number of the squares include trap indicia printed therein for reasons that will become apparent hereinafter. As shown in FIG. 4A, a plurality of first human tokens are included each representative of a soldier. FIG. 4B shows a plurality of second human tokens each representative of a prisoner. Also included is a plurality of third human tokens each representative of a leader, as shown in FIG. 4C. Lastly, a plurality of playing cards are provided including trap cards having a number of human tokens lost printed thereon. The playing cards further include a plurality of tunnel cards. FIG. 2 shows one of the plurality of dice included with the present invention.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new military board game apparatus and method which has many of the advantages of the board games mentioned heretofore and many novel features that result in a new military board game which is not anticipated, rendered obvious, suggested, or even implied by any of the prior art board games, either alone or in any combination thereof.

It is another object of the present invention to provide a new military board game which may be easily and efficiently manufactured and marketed.

It is a further object of the present invention to provide a new military board game which is of a durable and reliable construction.

An even further object of the present invention is to provide a new military board game which is susceptible of a low cost of manufacture with regard to both materials and labor, and which accordingly is then susceptible of low prices of sale to the consuming public, thereby making such military board game economically available to the buying public.

Still yet another object of the present invention is to provide a new military board game which provides in the apparatuses and methods of the prior art some of the advantages thereof, while simultaneously overcoming some of the disadvantages normally associated therewith.

Still another object of the present invention is to provide a new military board game for simulating the rescue of prisoners of war with a board game.

Even still another object of the present invention is to provide a new military board game that includes a game board with a top surface and a bottom surface. The top surface has a first indicia, a second indicia and a single path connected between the first indicia and second indicia comprising a plurality of squares. A predetermined number of the squares include trap indicia printed therein. Also included are a plurality of first human tokens each representative of a soldier and a plurality of second human tokens each representative of a prisoner. A plurality of playing cards include trap cards each having a number of human tokens lost printed thereon. To facilitate play, a plurality of dice are provided. During such play, the players attempt to move the solder human tokens from the first indicia to the second indicia whereafter the players attempt to move the prisoner human tokens from the second indicia to the first indicia.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a perspective view of the dice of the present invention.

FIG. 3 is a perspective view of the playing cards of the present invention.

FIG. 4A is a perspective view of one of the human tokens of the present invention.

FIG. 4B is a perspective view of one of the human tokens of the present invention.

FIG. 4C is a perspective view of one of the human tokens of the present invention.

DESCRIPTION OF THE PREFERRED EMBODIMENT

Figure 1:
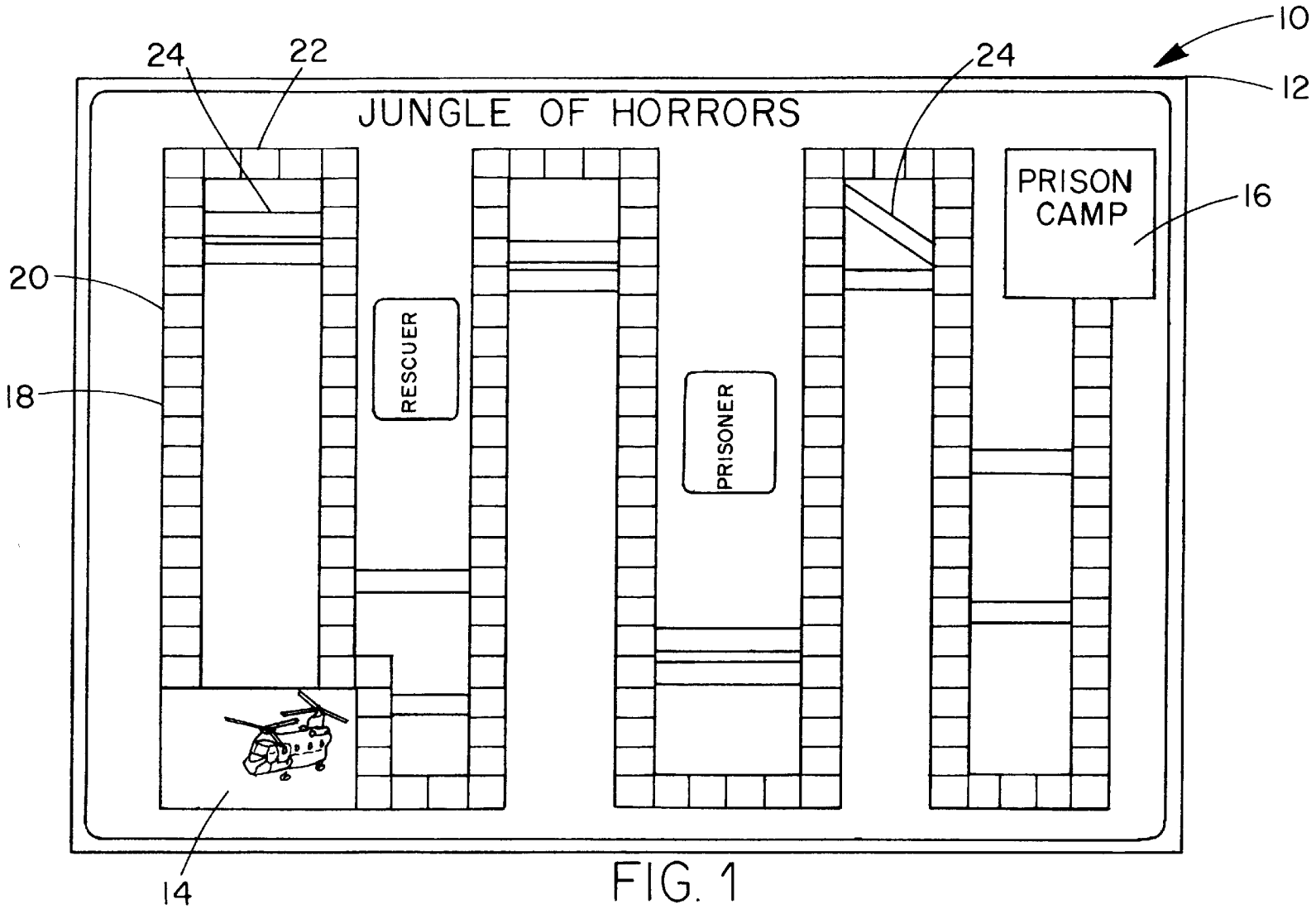
FIG. 1 is a top view of the game board of a new military board game according to the present invention.

With reference now to the drawings, and in particular to FIGS. 1 through 4C thereof, a new military board game embodying the principles and concepts of the present invention and generally designated by the reference numeral 10 will be described.

The present invention, as designated as numeral 10, includes a game board 12 having a rectangular configuration with a top surface and a bottom surface. The top surface includes a first large box indicia 14, representative of a helicopter, situated at a first corner thereof and a second large box indicia 16, representative of a prisoner camp. The second large box indicia is situated at a second corner of the game board diagonally situated within respect to the first corner thereof. Note FIG. 1.

A plurality of elongated vertical rows 18 are situated on the game board. Each vertical row comprises a plurality of adjacent squares 20 situated therealong. Associated therewith is a plurality of short horizontal rows 22 each comprising a plurality of adjacent squares situated therealong. The vertical rows and horizontal rows are connected to define a single path connected between the first large box indicia and second large box indicia. The top surface further has a plurality of elongated rectangular strips 24, representative of tunnels, connected between squares situated within adjacent vertical paths. A predetermined number of the squares include unillustrated trap indicia printed therein for reasons that will become apparent hereinafter.

As shown in FIG. 4A, a plurality of first human tokens 26 are included each representative of a soldier. FIG. 4B shows a plurality of second human tokens 28 each representative of a prisoner. Also included is a plurality of third human tokens 30 each representative of a leader, as shown in FIG. 4C.

Lastly, a plurality of playing cards 32 are provided including trap cards having a number of human tokens lost printed thereon. The playing cards further include a plurality of tunnel cards. In the preferred embodiment, the playing cards are divided up between a rescuer stack and a prisoner stack. FIG. 2 shows one of the plurality of dice 34 included with the present invention. Skulls are preferably printed on the dice.

The method associated with the present invention will now be set forth. First, play begins with a plurality of the first human tokens being situated within the first large box indicia. The first human tokens are divided into groups corresponding to each player. Each group receives a single third human token included therewith.

Next, the groups are moved between the first large box indicia to the second large box indicia by taking turns. Each turn includes the step of rolling the dice and moving the group of the present player along a number of adjacent squares within the path equal to a number rolled. Upon landing upon a square with trap indicia situated thereon, the present player must pick one of the playing cards from the rescuer stack. If a trap card is selected, a number of first human tokens from the group is removed from the board, wherein such number corresponds to a number printed on a trap card. If, on the other hand, the tunnel card is picked and the group of the present player is situated on a square connected to one of the elongated strips, the player has the option of moving the group across the elongated rectangular strips to a square connected thereto. It should be noted that if all of the third human tokens are removed from the group of one of the players prior to reaching the second large box indicia, such player is required to start over at the first large box indicia with another group of human tokens. Upon reaching the second large box indicia, the player must roll the dice and further collect a number of second human tokens equal to a number rolled. The object of the game then switches to trying to return to the first large box indicia with at least one second human token.

Play continues from the second large box indicia to the first large box indicia in a manner similar to that set forth above with exception of picking prisoner playing cards instead of rescuer playing cards. It is now readily apparent that a distinction is made between the playing cards so that case scenario messages may be printed thereon which correspond to the present object of the game, to return to the first large box indicia, or helicopter. A winner is designated as a player who reaches the first large box indicia with at least one second human token.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A board game comprising:

a game board having a rectangular configuration with a top surface and a bottom surface, the top surface having a first large box indicia situated at a first corner thereof, a second large box indicia situated at a second corner thereof diagonally situated with respect to the first corner thereof, a plurality of elongated vertical rows each comprising a plurality of adjacent squares situated therealong, and a plurality of short horizontal rows each comprising a plurality of adjacent squares situated therealong, wherein the vertical rows and horizontal rows are connected to define a single path connected between the first large box indicia and second large box indicia, the top surface further having a plurality of elongated rectangular strips connected between squares situated within adjacent vertical paths, a portion of the squares including trap indicia printed therein;

a plurality of first human tokens each representative of a soldier;

a plurality of second human tokens each representative of a prisoner;

a plurality of third human tokens each representative of a leader;

a plurality of playing cards including trap cards having a number of human tokens lost printed thereon and a plurality of tunnel cards; and a plurality of dice.

2. A method of playing a board game comprising the steps of:

providing a game board with a top surface and a bottom surface, the top surface having a first indicia, a second indicia, a single path connected between the first indicia and second indicia comprising a plurality of squares, wherein a predetermined number of the squares include trap indicia printed therein;

providing a plurality of first human tokens each representative of a soldier;

providing a plurality of second human tokens each representative of a prisoner;

providing a plurality of playing cards including trap cards having a number of human tokens lost printed thereon;

providing at least one die;

situating a plurality of the first human tokens within the first indicia and dividing the first human tokens into groups corresponding to each player;

moving the groups between the first indicia to the second indicia, wherein a turn includes the steps of:

rolling the dice and moving along a number of adjacent squares within the path equal to a number rolled, picking one of the playing cards upon landing upon a square with trap indicia situated thereon, removing a number of first human tokens from the group corresponding to a number printed on a trap card upon the picking thereof, starting over at the first indicia with another group of human tokens upon removing all of the first human tokens from the group of the player, and obtaining a number of second human tokens upon the group of human tokens of the player reaching the second indicia; and moving the groups including second human tokens between the second indicia to the first indicia, wherein a turn includes the steps of:

rolling the dice and moving along a number of adjacent squares within the path equal to a number rolled, picking one of the playing cards upon landing upon a square with trap indicia situated thereon, removing a number of second human tokens from the group corresponding to a number printed on a trap card upon the picking thereof, starting over at the second indicia with another group of human tokens upon removing all of the second human tokens from the group of the player, and designating winner as a player who reaches the first indicia with at least one second human token.

3. A method of playing a board game as set forth in claim 2 wherein printed on the game board is a plurality of elongated vertical rows each comprising a plurality of adjacent squares situated therealong and a plurality of short horizontal rows each comprising a plurality of adjacent squares situated therealong, wherein the vertical rows and horizontal rows are connected to define the path.

4. A method of playing a board game as set forth in claim 2 wherein the top surface further has a plurality of elongated rectangular strips connected between squares and further provided is a plurality of tunnel cards, wherein the method further comprises the step of moving the group across the elongated rectangular strips to a square connected thereto upon the picking of a tunnel card only when the group is situated within a square connected to one of the rectangular strips.

5. A method of playing a board game comprising the steps of:

providing a game board having a rectangular configuration with a top surface and a bottom surface, the top surface having a first large box indicia situated at a first corner thereof, a second large box indicia situated at a second corner thereof diagonally situated within respect to the first corner thereof, a plurality of elongated vertical rows each comprising a plurality of adjacent squares situated therealong, and a plurality of short horizontal rows each comprising a plurality of adjacent squares situated therealong, wherein the vertical rows and horizontal rows are connected to define a single path connected between the first large box indicia and second large box indicia, the top surface further having a plurality of elongated rectangular strips connected between squares situated within adjacent vertical paths, wherein a predetermined number of the squares include trap indicia printed therein;

providing a plurality of first human tokens each representative of a soldier;

providing a plurality of second human tokens each representative of a prisoner;

providing a plurality of third human tokens each representative of a leader;

providing a plurality of playing cards including trap cards having a number of human tokens lost printed thereon and a plurality of tunnel cards;

providing a plurality of dice;

situating a plurality of the first human tokens within the first large box indicia and dividing the first human tokens into groups corresponding to each player, wherein each group has a single third human token included therewith;

moving the groups between the first large box indicia to the second large box indicia, wherein a turn includes the steps of:

rolling the dice and moving along a number of adjacent squares within the path equal to a number rolled, picking one of the playing cards upon landing upon a square with trap indicia situated thereon, removing a number of first human tokens from the group corresponding to a number printed on a trap card upon the picking thereof, starting over at the first large box indicia with another group of human tokens upon removing all of the first human tokens from the group of the player, moving the group across the elongated rectangular strips to a square connected thereto upon the picking of a tunnel card only when the group is situated within a square connected to one of the rectangular strips, and rolling the dice upon the group of human tokens of the player reaching the second large box indicia and further obtaining a number of second human tokens equal to a number rolled; and moving the groups including second human tokens between the second large box indicia to the first large box indicia, wherein a turn includes the steps of:

rolling the dice and moving along a number of adjacent squares within the path equal to a number rolled, picking one of the playing cards upon landing upon a square with trap indicia situated thereon, removing a number of second human tokens from the group corresponding to a number printed on a trap card upon the picking thereof, starting over at the second large box indicia with another group of human tokens upon removing all of the second human tokens from the group of the player, moving the group across the elongated rectangular strips to a square connected thereto upon the picking of a tunnel card only when the group is situated within a square connected to one of the rectangular strips, and designating winner as a player who reaches the first large box indicia with at least one second human token.

* * * * *